US005707161A

United States Patent [19]

Pessina

[11] Patent Number: 5,707,161

[45] Date of Patent: Jan. 13, 1998

[54] PRINTER WITH A MULTIPLE CONTINUOUS-SHEET PROCESSING CAPABILITY

[75] Inventor: Fabio Pessina, Rho, Italy

[73] Assignee: Compuprint S.p.A., Turin, Italy

[21] Appl. No.: 676,564

[22] Filed: Jul. 8, 1996

[30] Foreign Application Priority Data

Jul. 7, 1995 [EP] European Pat. Off. ..... 95830292

[51] Int. Cl.[6] ..... B41J 11/30; B41J 15/22

[52] U.S. Cl. ..... 400/616.2; 400/616.1; 400/690

[58] Field of Search ..... 400/616.1, 616.2, 400/690

[56] References Cited

U.S. PATENT DOCUMENTS 4,988,226 1/1991 Ito ..... 400/616.1

4,995,745 2/1991 Yokoi et al. ..... 400/616.2

5,037,222 8/1991 Quick et al. ..... 400/616.2

*Primary Examiner*—Egard S. Burr

*Assistant Examiner*—Amanda B. Sandusky

*Attorney, Agent, or Firm*—Ostrolenk, Faber, Gerb & Soffen, LLP

[57] ABSTRACT

In a printer with a multiple continuous-sheet processing capability, a first pusher tractor unit and a second pusher tractor unit disposed above the first feed continuous sheets from the front of the printer to a printing line along substantially straight paths and both are accessible from the front of the printer for the loading of continuous sheets into the tractors, the second simply by the opening of an anti-noise cover and the first by the tilting of the second unit about a pivot axis on the opposite side of the paths to the second unit in the position above the first.

8 Claims, 5 Drawing Sheets

PRINTER WITH A MULTIPLE CONTINUOUS-SHEET PROCESSING CAPABILITY

BACKGROUND OF THE INVENTION

The present invention relates to a printer with the capability of processing multiple continuous sheets and, more generally, multiple printing substrates.

The development of user demands requires office printers with large workloads to be able to process, in an interchangeable manner, various types of continuous sheets as well as cut sheets, inserted in the printer manually or automatically.

In some office applications, the user has to be able to select a particular type of printing substrate from a plurality of substrates without having to unload the previously-used printing substrates from the printer and without the need to load the printer with the printing substrate selected upon each selection.

The parking function is known for this purpose and has been used for some time for parking continuous sheets which are sent to a printing station by pusher tractor units.

A pair of pusher tractors continuously engages a continuous sheet with lateral perforations (generally, but not necessarily, a multi-copy continuous sheet) and guides the sheet positively towards or away from a printing station according to the direction of movement imparted by the tractors.

A continuous sheet permanently engaged in the pair of tractors can thus be sent towards the printing station and printed to a certain extent.

The printed portion can be separated manually or automatically downstream of the printing station.

The remaining portion of the continuous sheet can then be withdrawn upstream from the printing station whilst being retained by the pair of tractors which must necessarily be disposed upstream of the printing station.

The continuous sheet remains parked in the pair of tractors without having to be reloaded and is ready for further use upon demand but leaves the printing station free so that a different kind of printing substrate can be sent thereto.

The provision of a plurality of pusher tractors enables several continuous sheets to be used alternatively, one at a time whilst another sheet or several other sheets remain parked.

If all of the continuous sheets are parked simultaneously, cut sheets can be sent to the printing station manually or automatically.

The cut sheets do not need to be parked since they are picked up, sent to the printing station, printed and discharged from the printer one at a time, leaving the printing station free to receive any type of printing substrate for subsequent printing operations.

Printers of this type, which have two pairs of tractors with parking and individual sheet-feeding functions are described, for example, in European patent application No. 94830106.4 and in the publication JP-A-5104793.

In all of the printers of this type, in order to afford easy access to the pairs of tractors and to allow the continuous sheets to be loaded therein, one pair of tractors is disposed on the front of the printer for access to the tractors from the front and the other pair of tractors is disposed at the rear of the printer to afford unimpeded access to the tractors from the rear.

This involves the technical problem that the path followed by the paper, that is, by the continuous sheet fed by a pair of tractors from the tractors to the printing platen and to the printing line defined on the platen cannot be straight but is curved considerably and, upstream of the printing line, is wound along a large arc around the platen which is generally formed by a cylindrical rotary roller.

This limits the number of copies which can make up the continuous sheet and the number of copies which can be printed.

Moreover the inevitable relative slippages which occur between the various superposed sheets, with uneven and unpredictable recovery imparted by the tractors and by the binding normally provided between the sheets, have the inevitable result of poor print quality even if they do not go as far as causing tearing of the perforated edges of the continuous sheet and jamming of the printer.

SUMMARY OF THE INVENTION

This serious technical problem is solved by the printer of the present invention which has two continuous-sheet feed units, each of which transports a continuous sheet by pushing it along a substantially flat path between the unit and a printing line on a printer platen. Both of the two units are mounted in the body of the printer and both are accessible from the same predetermined wall of the printer body, which may be either the front wall or the rear wall of the printer, for the loading of a continuous printing sheet into each of the units.

The two units are disposed one above the other with an outer unit articulated to the printer body for pivoting about an axis disposed on the opposite side of the flat path to the unit from a working position in which the outer or second unit is disposed above the inner or first unit and prevents the loading thereof to a position in which the second unit affords free access to the first unit on the predetermined (front or rear) wall for the loading of the first unit with a continuous printing sheet.

The outer or second unit is advantageously articulated releasably to the printing body so as to constitute an optional component of the printer which can be added when specific applications require it.

BRIEF DESCRIPTION OF THE DRAWINGS

The characteristics and advantages of the invention will become clearer from the following description of a preferred embodiment and of its variants given with reference to the appended drawings, in which.

DETAILED DESCRIPTION OF THE PREFERRED EMBODIMENT

Figure 1:
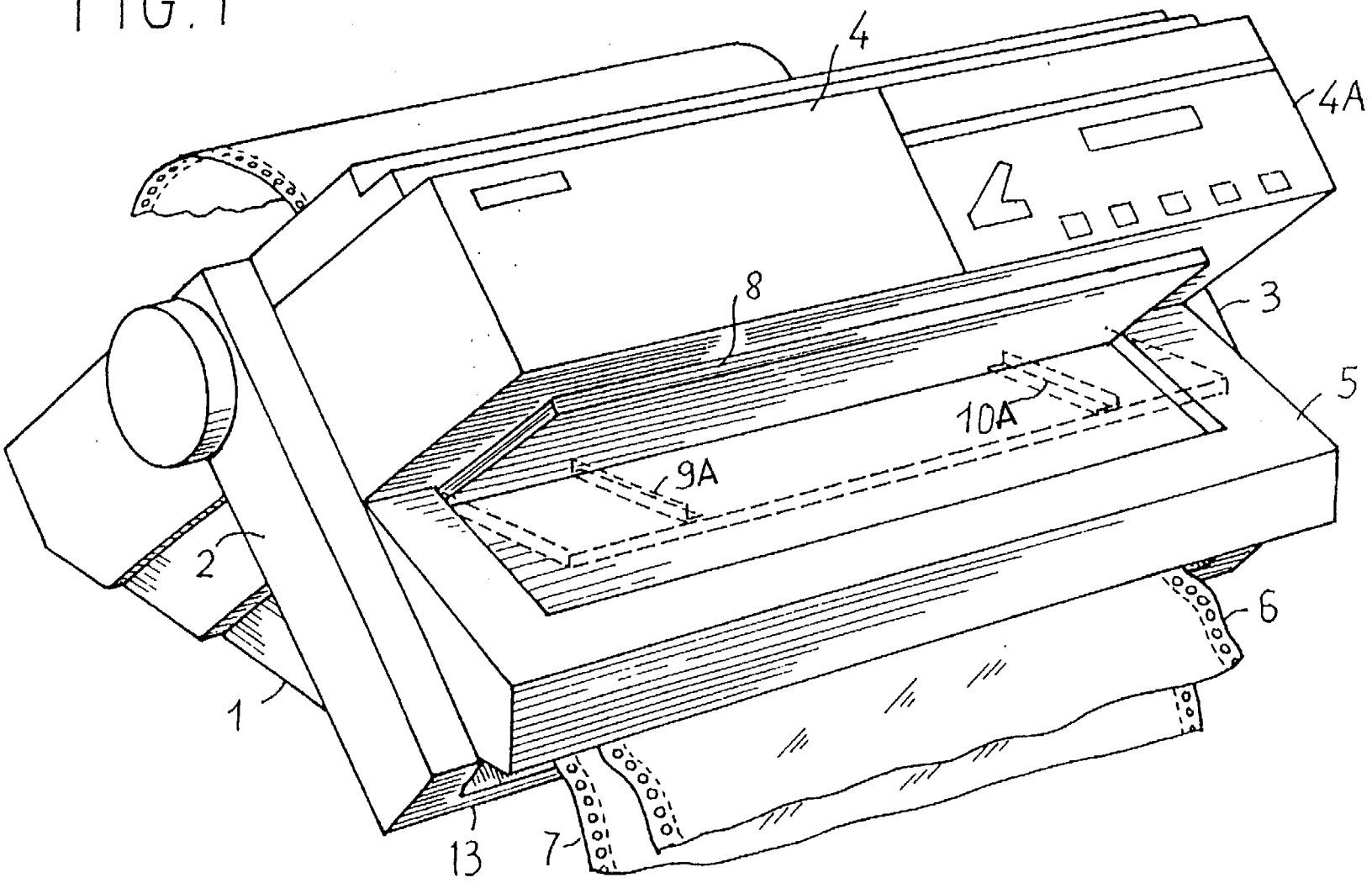
FIG. 1 is a frontal/lateral perspective view of a preferred embodiment of the printer according to the present invention.
Figure 2:
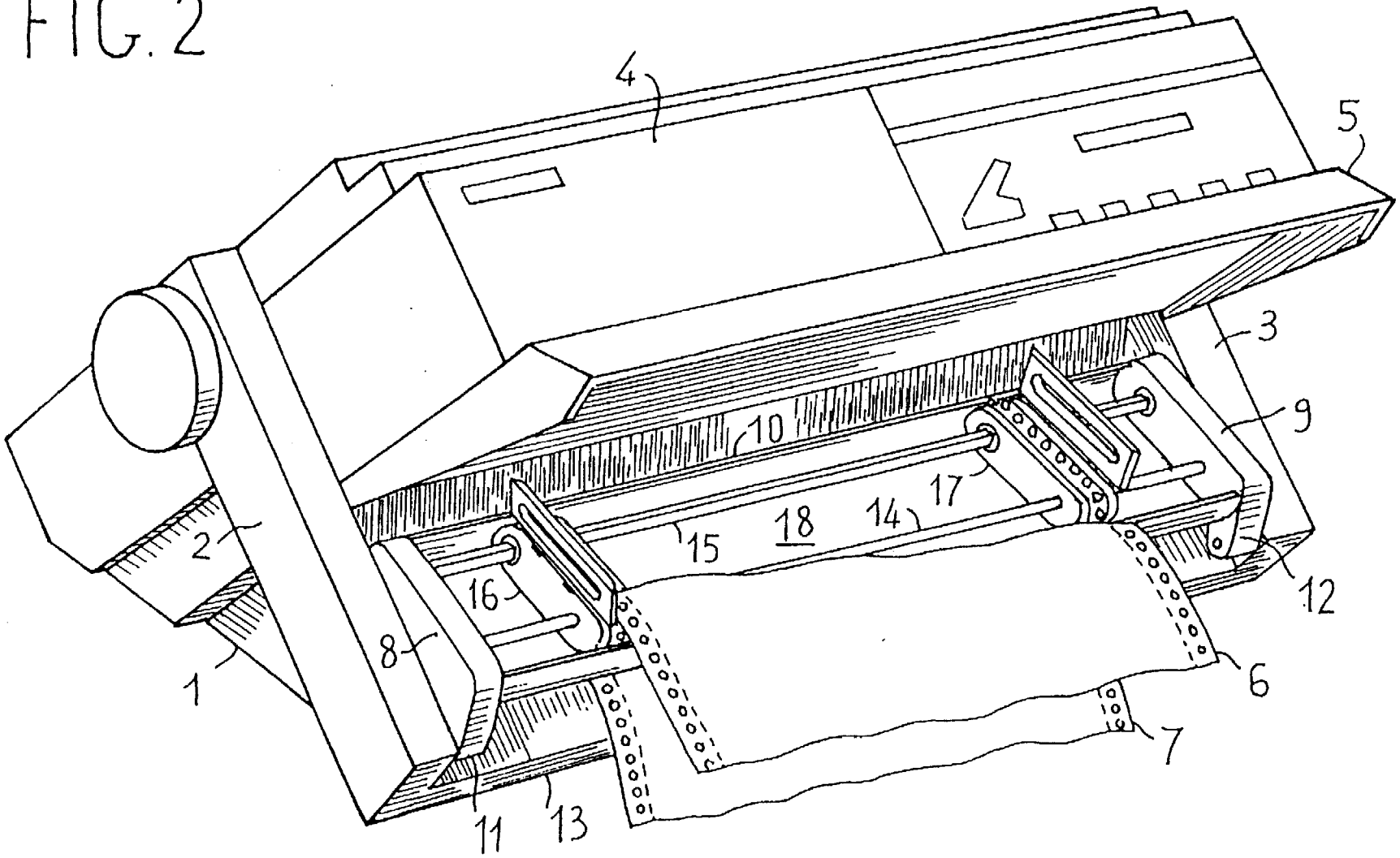
FIG. 2 is a frontal/lateral perspective view of the printer of FIG. 1 with a front anti-noise cover which is open to afford access to a first pair of tractors.
Figure 3:
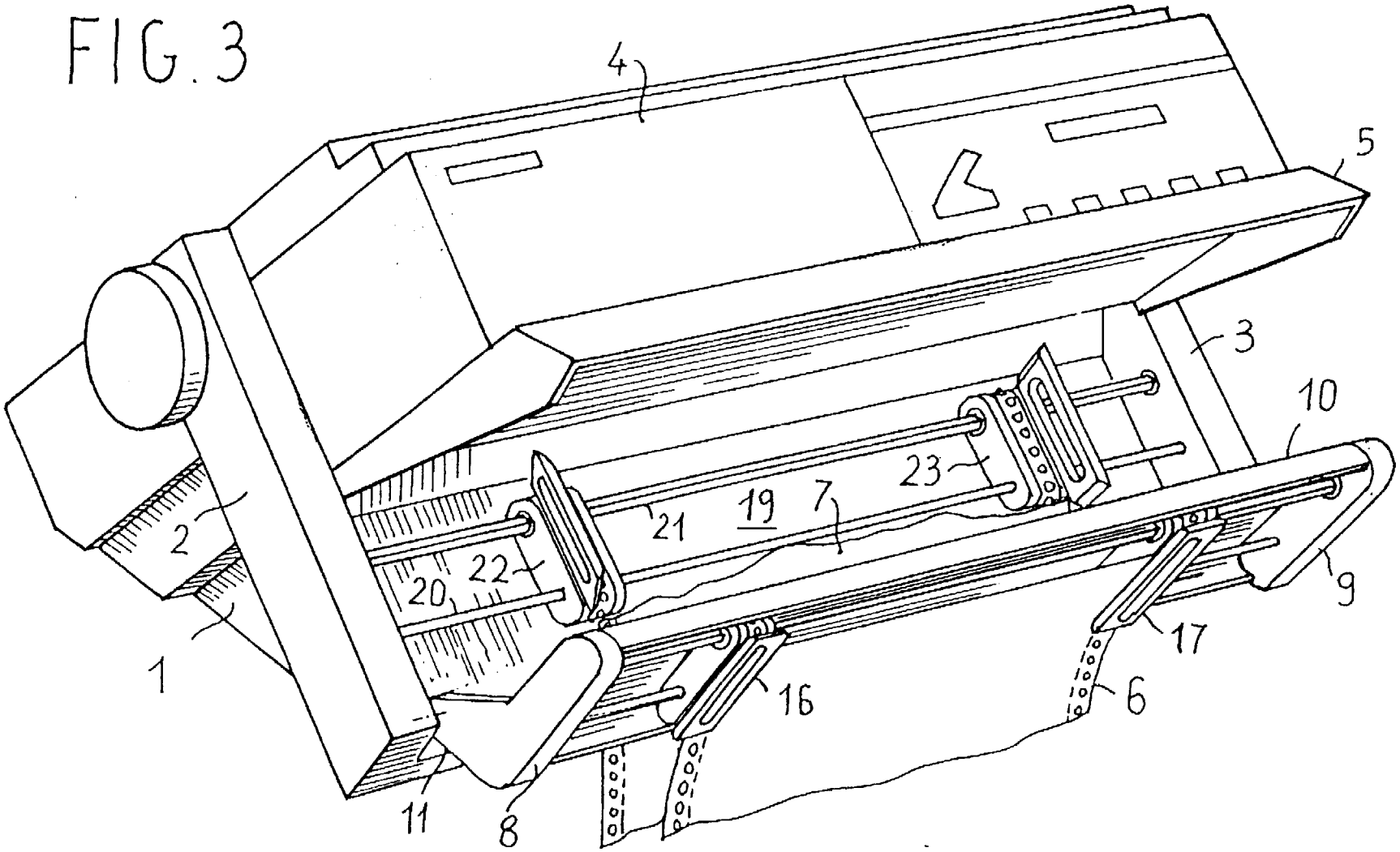
FIG. 3 is a frontal/lateral perspective view of the printer of FIGS. 1 and 2 with the front cover open and the first pair of tractors tilted to afford access to an underlying second pair of tractors.

With reference to FIGS. 1, 2 and 3, a printer according to the present invention comprises, essentially, a printer body constituted by a casing having a base 1 with two substantially triangular sides 2 and 3 and a mechanical frame, not visible, housed inside the casing. The casing also houses a power supply and conventional electronic control circuits of the printer, not shown.

A rectangular, parallelepipedal removable cover 4 is connected to an inclined edge of the sides 2, 3 and partially closes the front of the printer body at the top.

A second movable cover plate 5 closes the remaining, lower front portion of the body forming, with the upper front portion, a dihedral-shaped recess which is open at the front and sides of the printer.

The cover plate 5 is articulated to the printer body at the vertex of the dihedral-shaped recess and conceals two underlying continuous-sheet tractor feed units housed in the printer body between the sides 2, 3, the cover plate 5 forming, with the front edge 13 of the base 1, an elongate slot which extends between the sides 2,3 and, advantageously, is wide enough for the passage of the continuous printing sheets 6, 7 which are engaged in the tractors of the two continuous-sheet feed units.

Alternatively, the cover plate 5 may be removable, or completely absent, its main function being that of attenuating the noise produced by the printer and, in particular, by the movement of the continuous sheets.

A platform 8 for supporting cut sheets is articulated to the lower face of the cover 4 at the vertex of the dihedral and can be pivoted from the position shown, in which it is in contact with the lower face of the cover 4, to an open position shown in broken outline, in which the platform is substantially horizontal to provide a support for a sheet to be inserted in the printer manually.

The support platform 8 has adjustable guide rules 9A, 10A which permit precise alignment of the sheet introduced into the printer body through a slot formed between the cover 4 and the support platform 8 and leading to a pair of drive rollers.

The cover 4 comprises an operating panel 4A on its front face with display elements and push-buttons for the control and operation of the printer by an operator.

In FIG. 2, the cover plate 5 is shown in the open position in contact with the upper front portion of the printer body and shows that a housing is formed between the sides 2, 3 and the base and houses two tractor feed units for continuous printing sheets (hereinafter called tractor units).

One of these tractor units is clearly visible in FIG. 2 and comprises a frame 10 formed by a light extruded profiled section with a generally channel-shaped cross-section, closed at its ends by caps 8, 9 having appendages 11, 12 for articulation to the sides 2, 3, respectively, near the front edge 13 of the base 1.

A guide bar 14 extends between the caps 8, 9.

A square-sectioned drive shaft 15 extending parallel to the guide bar 14 is mounted for rotating freely between the caps 8, 9, by means of suitable bushes.

Two conventional tractors 16, 17 are mounted for sliding axially on the drive shaft 15 and on the guide bar 14.

One of the caps 8 houses suitable mechanical transmission means such as a gear keyed to the drive shaft 15 and not visible, coupled to corresponding conventional mechanical transmission devices, not shown, housed in the printer body.

The tractor unit is generally indicated 18.

As can be seen, easy access to the tractor unit in order to engage the continuous printing sheet 6 in the tractors 16, 17 is achieved simply by the opening (or removal) of the cover 5.

The tractors 16, 17, which are driven by the drive shaft 15, urge the continuous sheet 6 along a substantially straight path towards a printing platen causing it to emerge, once it has been printed, through a slot in the rear wall of the printer body.

The leading edge of the continuous sheet 6 can be returned to the tractors 16, 17 by the driving of the tractors 16, 17 in reverse, the sheet 6 being kept engaged in the tractors in a position known as the parking position.

As shown in FIG. 3, when the continuous printing sheet 6 is in the parking position, the tractor unit 18 can easily be pivoted or tilted through an angle of 90° or more on its articulation.

This operation affords access to a second tractor unit, generally indicated 19, which, in its simplest form, comprises a guide bar 20 extending between the sides 2 and 3, a drive shaft 21 parallel to the guide bar 20 and mounted for rotating freely between the sides 2, 3 and a pair of conventional tractors 22, 23 mounted for sliding axially on the drive shaft 21 and on the guide bar 20.

Since this tractor unit can generally constitute an unchanging component of the structure of the machine, the guide bar 20 can be fixed directly to the sides 2, 3 and the drive shaft 21 can be mounted for rotating freely on the sides 2, 3 and coupled mechanically to drive members by means of a mechanical transmission housed inside one of the sides.

Clearly, however, the tractor unit 19 may also constitute an optional module housed removably between the sides and, like the tractor unit 18, having a frame formed by a light profiled section closed by two end caps.

When, as shown in FIG. 3, the tractor unit 18 is tilted to the position for the loading of the underlying tractor unit 19, a fairly wide access slot is formed between the front edge 13 of the base and the light channel-shaped profiled section of the frame 10 of the tractor unit 18; a second continuous sheet 7 can be inserted through this slot by passing it beneath the continuous sheet 6 parked in the tractor unit 18 and can then easily be engaged in the tractors 22, 23.

The smooth and rounded outer surface of the frame 10 ensures that this operation is carried out without risk of the sheet 7 being caught on rough portions or of projecting obstacles interfering with manipulations by the operator.

When the continuous sheet 7 has been loaded into the tractors 22, 23, the tractor unit 18 can be returned to its working position, the cover 5 can be closed again and the printing functions of the printer can be activated.

Clearly, all of these operations can be carried out without the need to switch off the printer since, even if the tractor units have electrical elements, for example sensors for detecting the presence/absence of the sheet, or electromechanical controls for the engagement of the drive transmission to the drive shafts 15, 21 (for example, as described in European patent application No. 94830106.4) it is not necessary to remove either of the tractor units in order to load the other, neither is the electrical disconnection of any connector necessary, which operation may cause damage and malfunctioning if carried out when the equipment is live.

Clearly, there is nothing to prevent the articulated connection of the tractor unit 18 being releasable to enable it to be removed from the printer body and to be inserted in the printer body as an optional module, these operations being carried out, when necessary, with the equipment switched off.

As well as ensuring that the continuous-sheet feed units are easy to operate, this simple structural organization solves the technical problem of enabling the sheets to be supplied to the printing line correctly.

Figure 4:
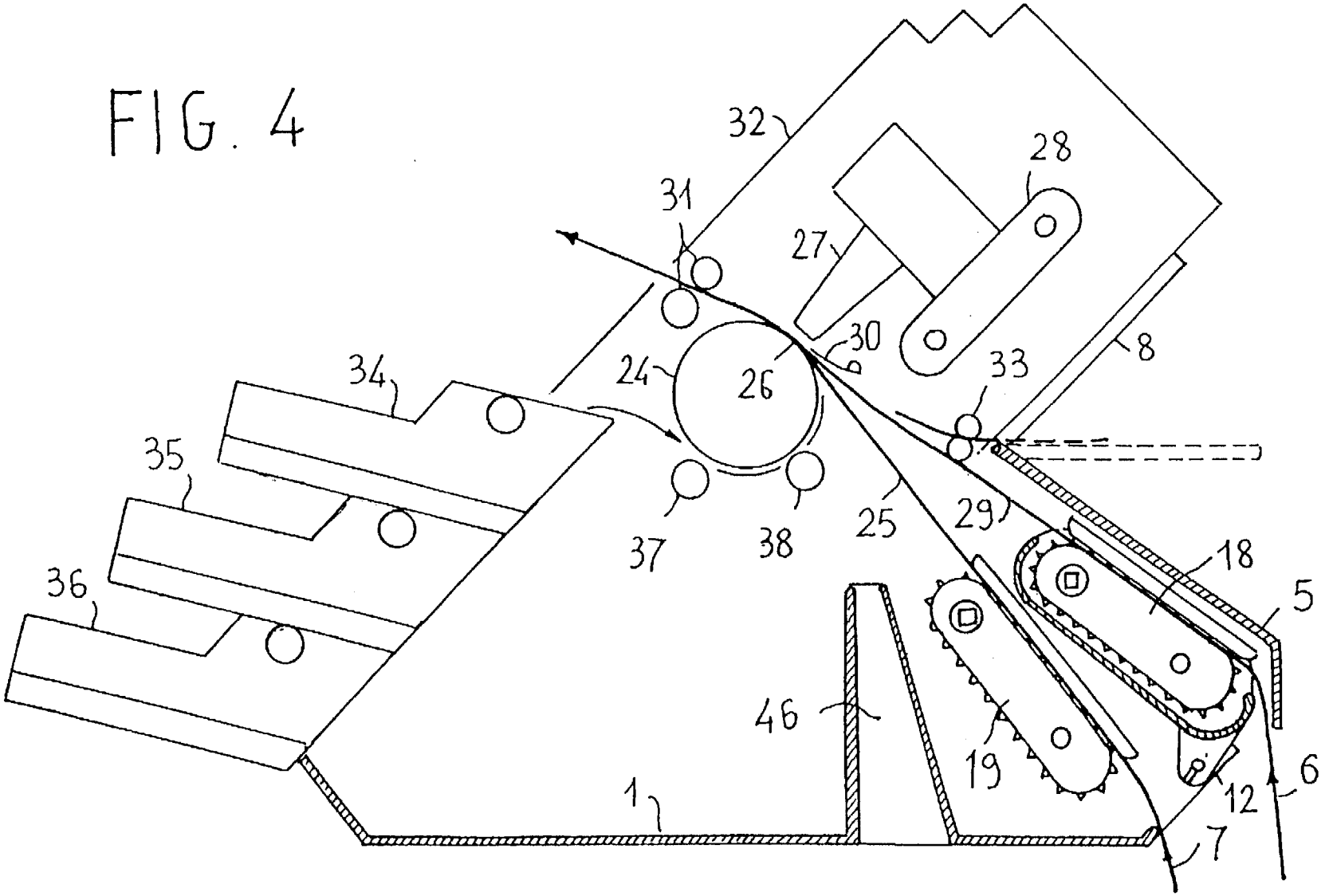
FIG. 4 shows the printer of FIG. 1, schematically and sectioned from front to rear, in the normal printing condition.

This is shown clearly in the sectional view of FIG. 4.

In FIG. 4, the continuous sheet 7 is urged by the tractor unit 19 towards a cylindrical printing platen 24 along a substantially straight path 25 coplanar with the entrainment plane of the tractors, tangential to the platen 24 along a generatrix 26 which defines a printing line along which a printing head 27 moves, for example, this may be a dot-matrix printing head of known type, mounted on a carriage 28 slidable on guide bars.

The continuous sheet 6 is urged towards the printing platen 24 by the tractor unit 18 along a path 29 which is also substantially straight and which diverges from the path 25 by a limited angle.

The two paths converge towards the printing line 26 slightly upstream thereof where a guide plate 30 exerts slight pressure on the continuous sheet to be printed to keep it in contact with the platen.

Downstream of the printing line 26, the path of the printing substrate extends without substantial bending through a pair of friction drive rollers 31 to an outlet opening in the rear wall 32 of the printer.

As already stated, the printer can also feed to the printing line cut sheets which rest on the tiltable platform 8 and are urged manually towards a pair of friction drive rollers 33.

An automatic feed with several cassettes 34, 35, 36 for single sheets may also be mounted on the rear wall of the printer for urging the individual sheets towards the rotating platen 24 in known manner. The platen cooperates with pressure rollers 37, 38 and guide plates to transport it towards the printing line 26.

Naturally, to enable individual sheets to be fed manually or automatically, the electronic printer circuits in known manner bring about parking of the continuous sheets which are withdrawn from the printing line towards the tractor units 18, 19 until the leading edges of the sheets are disposed in or near the tractors.

Figure 5:
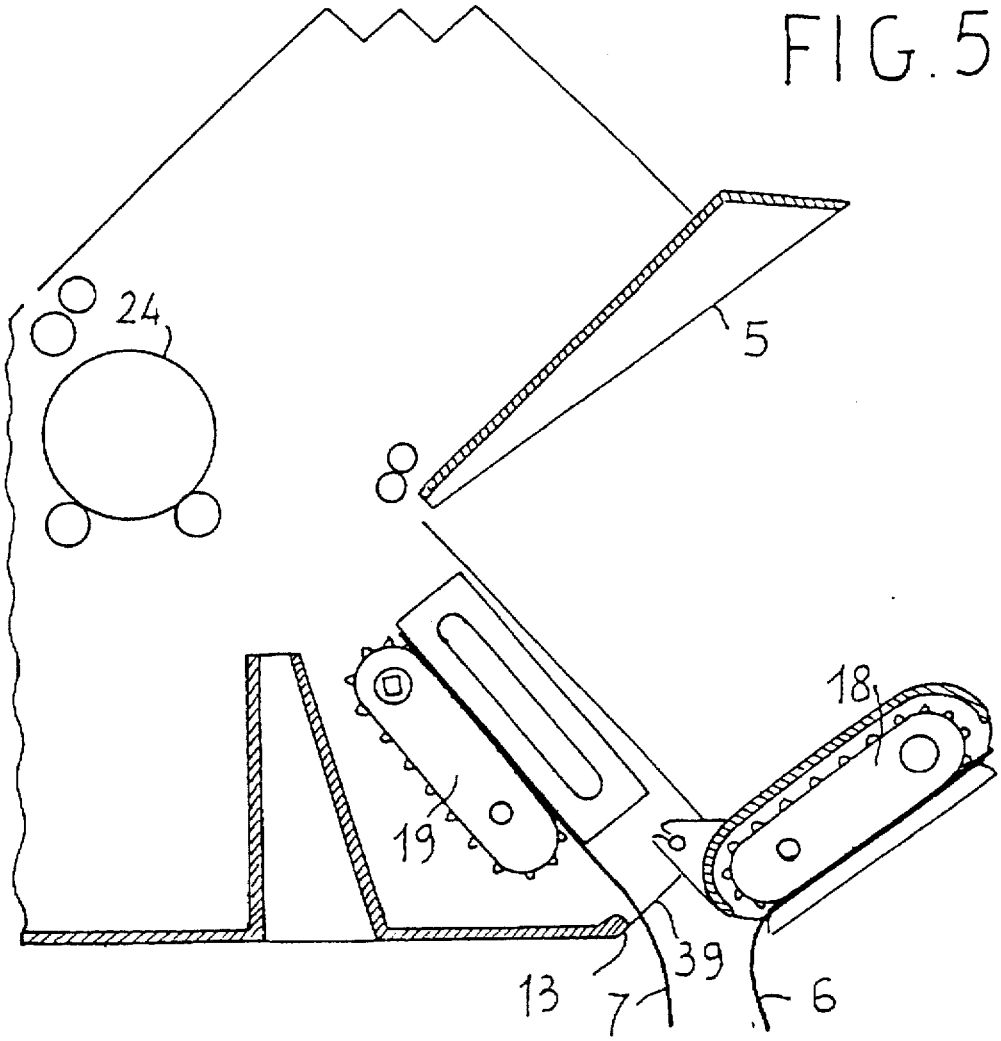
FIG. 5 shows the printer of FIG. 3 schematically and partially sectioned from front to rear with the first tractor unit tilted to afford access to the second tractor unit and to permit the loading thereof.

FIG. 5 shows the printer of FIG. 1 sectioned from front to rear with the tractor unit 18 disposed in the tilted position to show more clearly the convenience of the access to the tractor unit 19 in order to position the tractors along the guide bar and to open and close them.

FIG. 5 also shows the width of the slot 39 which is formed between the front edge 13 of the base and the frame 10 of the tractor unit 18 and which permits easy insertion of the continuous sheet 7 to be engaged in the tractor unit 19. Clearly, the base of the printer must bear on a support such as a work table with the front edge 13 disposed beside an edge of the table to allow unobstructed feeding of the continuous sheets during printing operations and the loading of the continuous sheets.

Naturally, stop devices may be provided on the sides 2, 3 or on one of these sides to limit the pivoting of the tractor unit 18.

Although the foregoing description refers to a printer with front feeding of the continuous sheets, clearly the same structural arrangement could be used in a printer with rear feeding of the continuous sheets.

Figure 6:
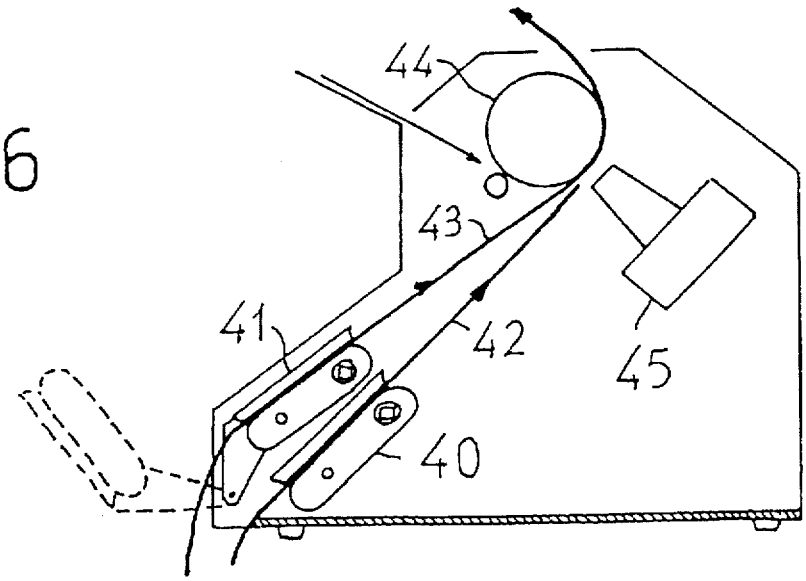
FIG. 6 shows schematically and sectioned from front to rear, a printer with two tractor units, one of which can be tilted and which are accessible from the rear of the printer.

FIG. 6 is a schematic view sectioned from front to rear showing, by way of example, a printer of this type in which two tractor units 40, 41 disposed one above the other and accessible from the rear of the printer, urge respective continuous printing sheets along two substantially straight paths 42, 43 which converge at a printing line formed between a platen 44 and a printing head 45.

The position to which the tractor unit 41 is tilted to permit access and loading of the tractor unit 40 is shown by ghost lines (in broken outline).

Clearly, therefore, for all that in current applications it may suffice for a printer to be provided with two tractor units for feeding two different types of continuous sheets, the same inventive concept can be extended to provide a printer in which more than two, for example three, tractor units are disposed one above another and are accessible from the front or from the rear of the printer in order to transport continuous sheets to a printing line along substantially straight paths.

A double-hinge or book-like articulation system then enables one, two or more tractors to be tilted to afford easy access to an underlying tractor unit for the loading thereof.

Naturally, a printer of the type described may have many other functions without the use of two tractor feed units both of which are accessible from the front or from the rear creating potential conflicts or incompatibility.

For example, as shown in FIG. 4, the printer base 1 may have a loading hopper 46 for the supply, from below, of a continuous sheet which is drawn towards the platen by tractors operating as pullers, disposed downstream of the platen on the rear wall 32, as described fully in the European patent application already cited.

I claim:

1. A printer with a multiple continuous-sheet processing capability in which a first continuous-sheet tractor feed unit operating as a pusher transports a continuous sheet along a first straight path between the unit and a print line, a printer body having walls, said first unit being mounted on a wall of said printer body so as to be accessible on said wall for the loading of a continuous printing sheet into the first unit, comprising:

a second continuous-sheet tractor feed unit in a position above said first unit and operating as a pusher to transport a continuous sheet along a second straight path between said second feed unit and the print line, said second unit being accessible on said wall for the loading of a continuous printing sheet into said second unit, and articulation means for pivotally connecting said second unit to said printer body with an axis of articulation disposed perpendicular to said straight paths so that said second unit can pivot freely from said position above said first unit to a tilted position in which said second unit affords free access to said first unit for the loading of a continuous printing sheet into the first unit even in the presence of a continuous sheet parked in the second unit.

2. A printer according to claim 1 in which the second continuous-sheet tractor feed unit is articulated releasably to the body.

3. A printer according to claim 1 in which said wall of the printer body is a front wall.

4. A printer according to claim 3 in which the front wall forms a dihedral-shaped recess with its vertex parallel to the articulation axis, the first and second units being accessible through the dihedral-shaped recess.

5. A printer according to claim 4, comprising cut sheet-feed means with friction rollers and a support platform articulated to the printer body at the vertex of the dihedral-shaped recess for pivoting between a first position in which the support platform is adjacent an upper face of the dihedral-shaped recess and a second position in which the platform is pivoted away from the upper face in order to support separate sheets for insertion in the friction-roller feed means.

6. A printer according to claim 5, comprising an anti-noise cover which can be opened and which is articulated to the printer body and disposed above the second unit.

7. A printer according to claim 6, in which said cover is articulated to the body with an articulation axis at the vertex of the dihedral-shaped recess.

8. A printer according to claim 1 wherein said axis of articulation is between said first and second units.

* * * * *